US006860747B2

(12) United States Patent
Nguyen

(10) Patent No.: US 6,860,747 B2
(45) Date of Patent: Mar. 1, 2005

(54) SYSTEM AND METHOD FOR MOUNTING A PROCESSOR

(75) Inventor: Minh H. Nguyen, Katy, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/448,833

(22) Filed: May 30, 2003

(65) Prior Publication Data

US 2004/0242047 A1 Dec. 2, 2004

(51) Int. Cl.[7] ..... H01R 13/625; H01R 4/50
(52) U.S. Cl. ..... 439/342
(58) Field of Search ..... 439/342

(56) References Cited

U.S. PATENT DOCUMENTS 4,988,310 A * 1/1991 Bright et al. ..... 439/342
5,013,256 A * 5/1991 Matsuoka et al. ..... 439/264
5,669,780 A * 9/1997 Fukunaga ..... 439/266
6,116,936 A * 9/2000 Pei ..... 439/342
6,338,639 B1 1/2002 Trout et al.
6,377,474 B1 4/2002 Archambeault et al.
6,406,317 B1 * 6/2002 Li et al. ..... 439/342
6,431,899 B1 * 8/2002 Keller ..... 439/342
6,482,022 B2 11/2002 Trout et al.

* cited by examiner

*Primary Examiner*—Javaid H. Nasri

(57) ABSTRACT

A system and method for coupling a multi-pin device to a system board within an electronic device. A socket is used to couple the multi-pin device to the system board. A spring member biases the socket to a fully opened position for insertion of the multi-pin device. An actuator enables selective movement of the multi-pin device into operative engagement with the system board.

22 Claims, 4 Drawing Sheets

SYSTEM AND METHOD FOR MOUNTING A PROCESSOR

BACKGROUND OF THE INVENTION

Processors are utilized in a variety of electronic devices, such as servers and other computer-based devices. In some devices, the processor is mounted to a system board by a socket which holds the processor in operative engagement with the system board.

Sockets are designed to receive the pins of a processor while in an open position and to transition those pins into conductive contact with the system board when in a closed position. However, when the processors are pressed into the socket while the socket is in a closed or partially open position, damage can result. For example, the processor pins can be bent or otherwise damaged. Also, the pins may be inserted into the wrong openings and moved into contact with the wrong contacts on the system board. This can lead to a damaged or destroyed system board and/or processor. Additionally, the socket can be cracked or otherwise damaged during the attempted installation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
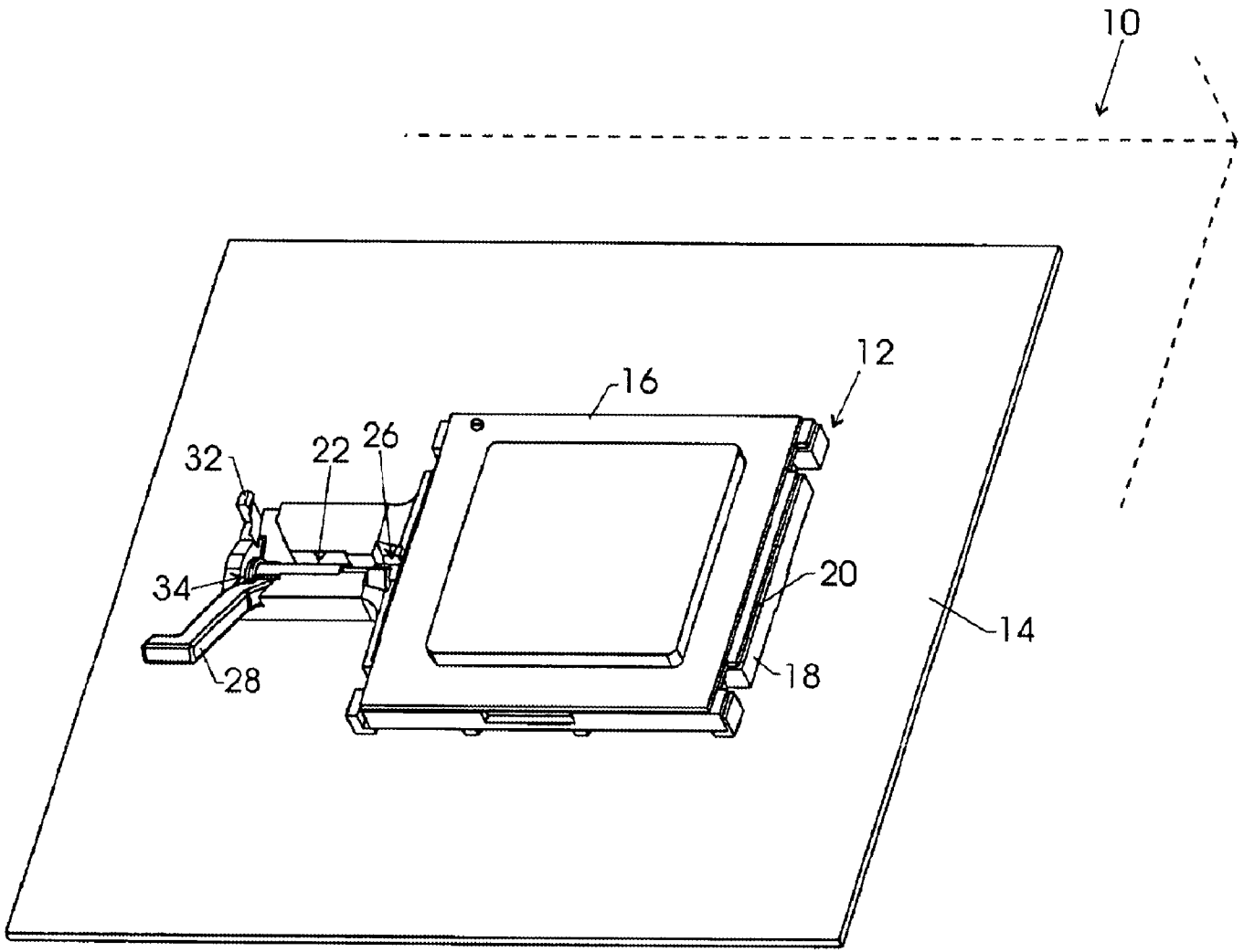
FIG. 1 is an isometric view of a system utilizing a socket for mounting a multi-pin device to a system board according to an embodiment of the present invention.
Figure 2:
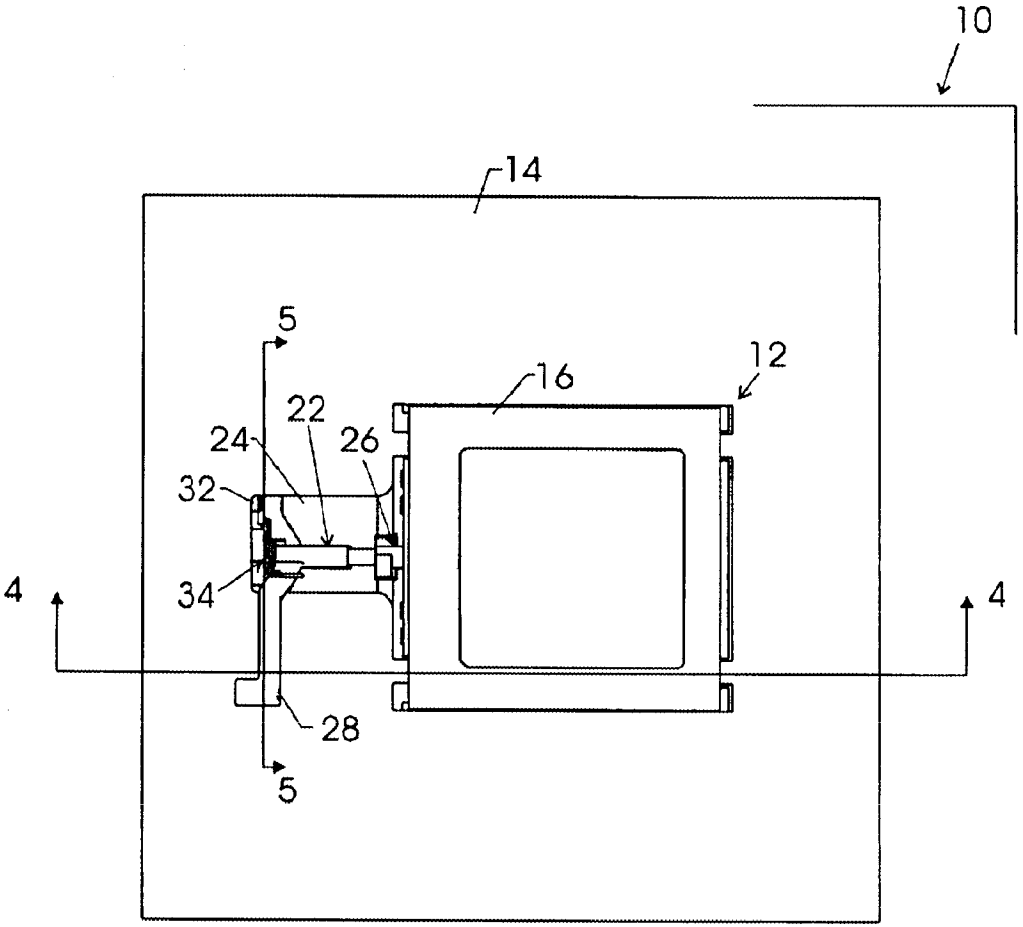
FIG. 2 is a top view of the system illustrated in FIG. 1.

Referring generally to FIGS. 1 and 2, an electronic device 10 is illustrated according to an embodiment of the present invention. Electronic device 10 may comprise a variety of devices, such as a server, a workstation, a personal computer or other electronic devices. In the embodiment illustrated, electronic device 10 comprises a socket 12 positioned between a system board 14 and a multi-pin device 16, such as a processor. The socket 12 may be mounted to system board 14 and used to operatively engage processor 16 with system board 14. The configuration of socket 12 may vary depending on the type of processor and system board. For example, socket 12 may be a 603 pin standard, 604 pin standard or other pin standard socket.

Figure 3:
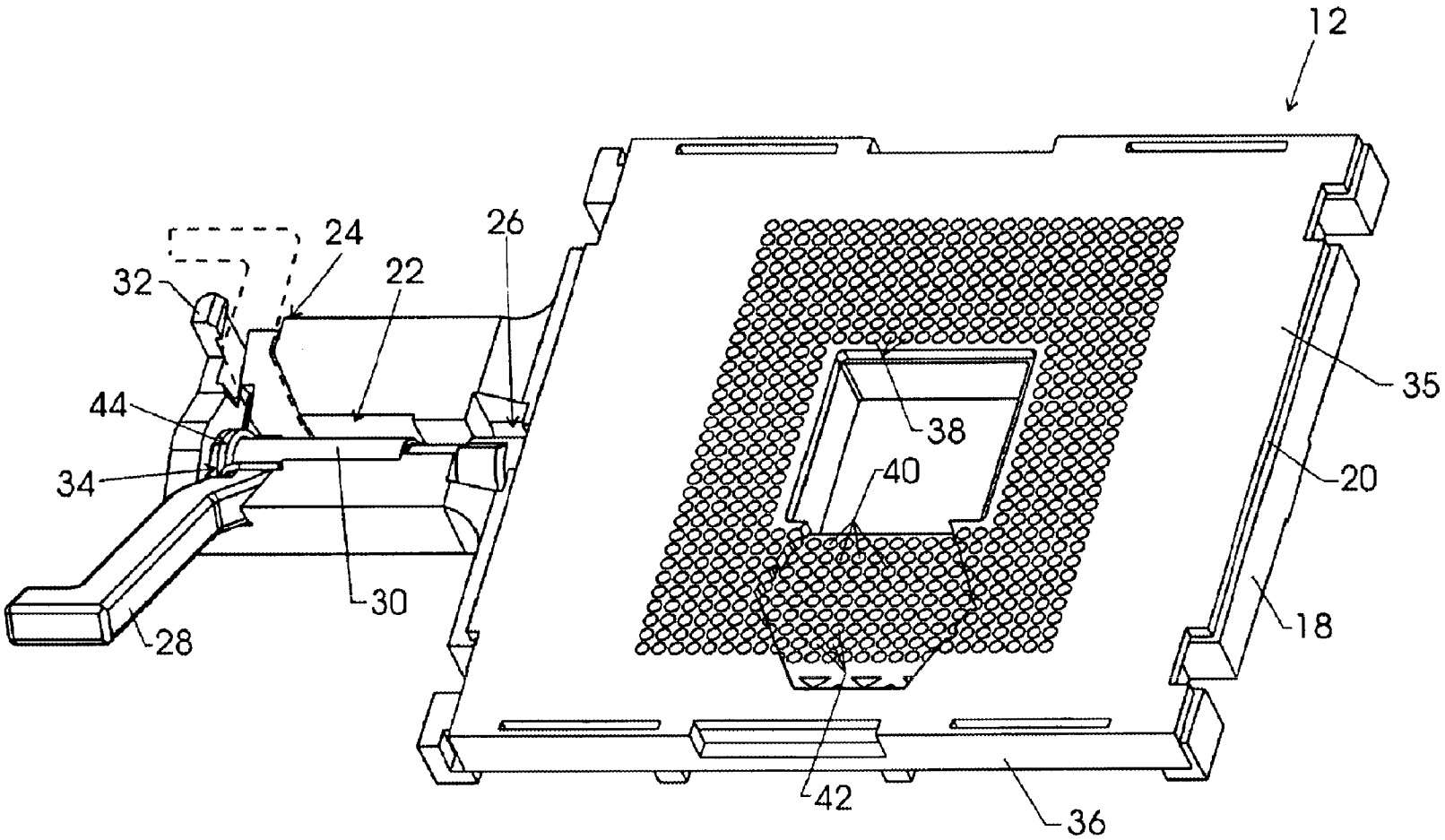
FIG. 3 is an isometric view of an embodiment of the socket illustrated in FIG. 1.

With further reference to FIG. 3, the illustrated embodiment of socket 12 comprises a socket base 18 and a socket cover 20 moveably mounted to socket base 18. For example, socket cover 20 may be slideably mounted to socket base 18. Socket cover 20 is moved relative to socket base 18 via an actuator 22. Actuator 22 transitions socket cover 20 between a fully opened position for receiving processor 16 and a fully closed position that moves the pins of processor 16 into secure conductive engagement with system board 14.

In the embodiment illustrated, actuator 22 is mounted to an extended portion 24 of socket base 18. The actuator 22 acts against socket cover 20 via an actuator member 26 to force relative motion between socket cover 20 and socket base 18. Actuator member 26 may comprise a variety of mechanisms, such as a screw engaging corresponding screw threads on socket cover 20, a cammed surface acting against socket cover 20, a plurality of angled slide surfaces acting against corresponding slide surfaces on socket cover 20 or other mechanisms to provide relative movement. Alternatively, actuator 22 can be mounted to socket cover 20 and positioned to act against socket base 18 to provide the relative motion between socket base 18 and socket cover 20.

One embodiment of actuator 22 comprises a lever 28 coupled to actuator member 26 via a shaft 30. Lever 28 may be moved between a fully opened position, as illustrated in FIG. 3 in solid lines, and a fully closed position, as illustrated in FIG. 3 in dashed lines. A catch 32 can be positioned to hold lever 28 in the fully closed position.

Furthermore, lever 28 is biased to the opened position. For example, a spring member 34 may be utilized to force actuator 22 to the fully opened position. In the embodiment illustrated, spring member 34 forces lever 28 to the fully opened position once lever 28 is released from catch 32.

Figure 4:
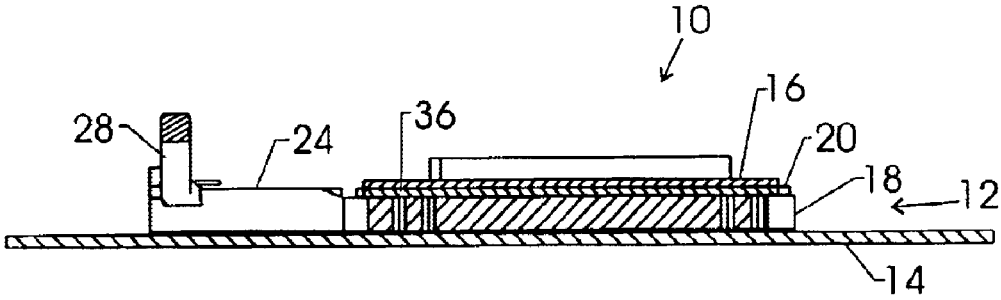
FIG. 4 is a cross-sectional view taken generally along line 4—4 of FIG. 2.

Referring generally to FIGS. 3 and 4, socket cover 20 comprises a generally planar wall 35 that slides over a top surface of socket base 18. Wall 35 may be coupled to socket base 18 by side wall slides 36. Socket cover 20 comprises a plurality of openings 38 through which the pins of processor 16 are inserted when processor 16 is mounted on socket 20, as illustrated in FIG. 4. Furthermore, socket base 18 comprises a plurality of base openings 40 into which the pins of processor 16 also extend. When actuator 22 is in the fully opened position, the openings 38 of socket cover 20 are properly aligned with the base openings 40 of socket base 18. Thus, processor 16 may be securely and consistently mounted to socket 12 without damage to the processor pins or socket and without forcing the pins of processor 16 into the incorrect base openings 40. Spring member 34 ensures that actuator 22 is moved to the fully opened position when a processor or other multi-pinned component is mounted on socket 12.

Once processor 16 is properly mounted on socket 12, as illustrated in FIG. 4, actuator 22 is moved to the fully closed position. In the example illustrated, lever 28 is transitioned from the fully opened position to the closed position illustrated by dashed lines in FIG. 3. As actuator 22 is moved, socket cover 20 shifts with respect to socket base 18 to securely move the pins of processor 16 against appropriate conductive contacts 42 in base opening 40. The conductive contacts 42 are appropriately engaged with given circuitry on system board 14.

It should be noted that different types of spring members 34 may be utilized at a variety of locations to insure actuator 22 is always moved to a fully opened position. For example, spring member 34 may be positioned to act against lever 28; the spring member may be positioned around shaft 30; the spring member 34 may be positioned directly between socket base 18 and socket cover 20; and the spring member may be mounted externally of the socket. Similarly, a variety of spring types, such as torsion springs, compression springs, extension springs, leaf springs and other types of springs may be incorporated into the design to ensure that actuator 22 is transitioned to the fully opened position once released from the closed position.

Figure 5:
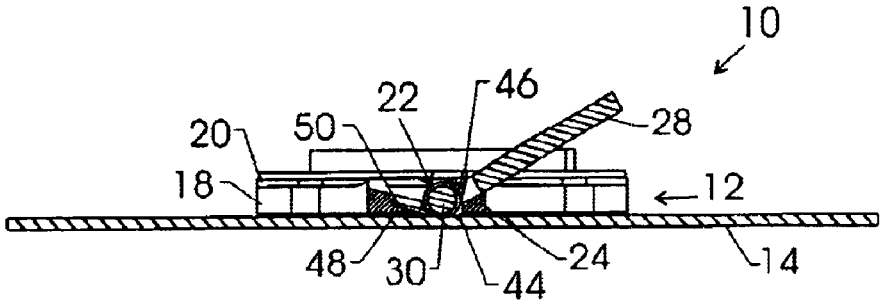
FIG. 5 is a cross-sectional view taken generally along line 5—5 of FIG. 2.

By way of example, a torsion spring 44 is illustrated. In FIG. 5, torsion spring 44 is illustrated as mounted around shaft 30. The torsion spring comprises a first spring arm 46 that acts against lever 28. A second spring arm 48 is captured in a recess 50 formed in extended portion 24 of socket base 18. The spring arms 46 and 48 are sufficiently preloaded to force actuator 22, e.g. lever 28, to the fully opened position for insertion of processor 16. To transition actuator 22 to a fully closed position, a user must apply sufficient force against the actuator to overcome the spring bias and to move the actuator to the fully closed position. The actuator may be held in the closed position by, for example, catch 32. Accordingly, processors or other multi-pinned devices can be operatively engaged with a variety of boards 14 via socket 12 with minimal risk of damage to the multi-pin device, socket or system board.

What is claimed is:

1. A system, comprising:

an electronic device having a board, a socket disposed on the board and a multi-pin device couplable to the board by the socket, the socket having a socket base, a socket cover slidably mounted to the socket base, and an actuator to transition the socket cover, the socket base, or a combination thereof between a pin receiving configuration and a pin engagement configuration to releasably couple the multi-pin device to the board, wherein the socket cover has a plurality of apertures configured to receive a plurality of pins of the multi-pin device therethrough;

a catch mechanism having a resilient member configured to releasably secure the actuator to maintain the socket cover and the socket base in the pin engagement configuration; and a biasing mechanism configured to bias the socket base, socket cover, or a combination thereof to the pin receiving configuration.

2. The system as recited in claim 1, wherein the actuator comprises a lever.

3. The system as recited in claim 1, wherein the electronic device comprises a server.

4. The system as recited in claim 1, wherein the socket comprises a 603 pin standard socket.

5. The system as recited in claim 1, wherein the socket comprises a 604 pin standard socket.

6. The system as recited in claim 1, wherein the socket base comprises a protruding portion configured to support the actuator.

7. A device, comprising:

a socket to couple a multi-pin device to a board, the socket comprising an actuator to transition the socket between a pin receiving configuration and a pin engagement configuration such that the pin engagement configuration operatively engages the multi-pin device with the board, the socket further comprising a spring member positioned to bias the actuator to the pin receiving configuration, wherein the socket comprises a socket base and a socket cover that has a plurality of apertures configured to receive a plurality of pins of the multi-pin device therethrough and that is slidably mounted with respect to the socket base, the actuator causing relative movement between the socket base and the socket cover and being disposed on a protruding portion extending from at least one of the socket base and the socket cover.

8. The system as recited in claim 7, comprising a catch mechanism including an elastically deformable member configured to secure the actuator such that the socket cover and socket base are maintained in the pin engagement configuration.

9. The device as recited in claim 7, further comprising a catch positioned to hold the actuator in the engagement configuration.

10. The device as recited in claim 7, wherein the actuator comprises a lever and the spring member comprises a torsion spring coupled to the lever.

11. A method, comprising:

providing a socket with a socket base and a socket cover to receive a multi-pin device for engagement with a board;

providing an actuator having a lever disposed on a protruding portion extending from at least one of the socket cover and socket base to enable selective movement of at least one of the socket cover and the socket base relative to one another between a pin receiving configuration and a pin engagement configuration; and spring biasing the socket base, the socket cover, or a combination thereof towards the pin receiving configuration.

12. The method as recited in claim 11, further comprising mounting the socket in a server.

13. The method as recite in claim 11, further comprising positioning the multi-pin device on the socket with the socket in the pin receiving configuration.

14. The method as recited in claim 13, further comprising moving the actuator to a closed position to couple the multi-pin device to the board.

15. The method as recited in claim 11, further comprising:

maintaining the actuator in the closed position with a resilient catch.

16. A system, comprising:

a socket configured to receive a multi-pin device, comprising:

means for moving a socket base, a socket cover, or a combination thereof with respect to one another between a pin receiving configuration and a pin engagement configuration;

means for biasing the socket cover, the socket base, or a combination thereof to the pin receiving configuration with respect to one another;

means for locating the means for moving at a distance from the socket base and the socket cover; and means for releasably securing the means for moving such that the socket is maintained in the pin engagement configuration.

17. The system as recited in claim 16, wherein the means for moving comprises a socket having the socket cover slidably engaged with the socket base.

18. The system as recited in claim 16, wherein the means for moving comprises an actuator.

19. The system as recited in claim 16, wherein the means for biasing comprises a spring.

20. A securing apparatus for coupling a multi-pin device to a board, comprising:

a first portion having a first set of apertures that extend through the first portion and that are configured to receive a plurality of communication pins of the multi-pin device;

a second portion that is positionably coupled to the first portion and that has a second set of apertures configured to receive the plurality of communication pins of the multi-pin device;

a plurality of electrical contacts electrically coupled to the board and disposed in at least one of the first and second sets of apertures;

an actuation mechanism that includes a lever for transitioning the first and second portions with respect to one another between a pin receiving configuration and a pin engagement configuration and that is disposed on at least one of the first and second portions, wherein the plurality of electrical contacts are configured to engage with the communication pins of the multi-pin device when the first and second portions are in the pin engagement configuration;

a biasing mechanism configured to bias the first or second portions or a combination thereof to the pin receiving configuration with respect to one another; and an elastically deformable catch mechanism configured to releasably secure the lever of the actuation mechanism such that the first and second portions are maintained in the pin engagement configuration.

21. The securing apparatus as recited in claim 20, wherein the biasing mechanism comprises a spring configured to bias the lever such that the first and second portions are biased to the pin receiving configuration.

22. The scouring apparatus as recited in claim 20, comprising a protruding portion extending from at least one of the first and second portions, wherein the lever is disposed on the protruding portion.

* * * * *